US010449565B2

(12) United States Patent
Ikushima

(10) Patent No.: US 10,449,565 B2
(45) Date of Patent: Oct. 22, 2019

(54) APPLICATION DEVICE AND APPLICATION METHOD

(71) Applicant: MUSASHI ENGINEERING, INC., Tokyo (JP)

(72) Inventor: Kazumasa Ikushima, Tokyo (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 91 days.

(21) Appl. No.: 15/122,552

(22) PCT Filed: Mar. 9, 2015

(86) PCT No.: PCT/JP2015/056800
§ 371 (c)(1),
(2) Date: Aug. 30, 2016

(87) PCT Pub. No.: WO2015/137271
PCT Pub. Date: Sep. 17, 2015

(65) Prior Publication Data

US 2017/0066005 A1 Mar. 9, 2017

(30) Foreign Application Priority Data

Mar. 10, 2014 (JP) ..... 2014-046978

(51) Int. Cl.
*B05C 5/02* (2006.01)
*B05D 1/26* (2006.01)
*B05C 13/00* (2006.01)

(52) U.S. Cl.
CPC ..... *B05C 5/0291* (2013.01); *B05C 5/0212* (2013.01); *B05C 5/0225* (2013.01); (Continued)

(58) Field of Classification Search
CPC ..... B05C 5/0291
See application file for complete search history.

(56) References Cited

U.S. PATENT DOCUMENTS 5,747,102 A 5/1998 Smith et al.
6,253,957 B1 7/2001 Messerly et al.
(Continued)

FOREIGN PATENT DOCUMENTS

CN 102421536 A 4/2012
CN 103391820 A 11/2013
(Continued)

OTHER PUBLICATIONS

International Search Report dated Jun. 9, 2015, issued in counterpart Application No. PCT/JP2015/056800. (2 pages).
(Continued)

*Primary Examiner* — Robert A Vetere
(74) *Attorney, Agent, or Firm* — Westerman, Hattori, Daniels & Adrian, LLP

(57) ABSTRACT

An application device and an application method capable of increasing the speed of a line-drawing application are provided. The application device includes a discharge device, a worktable, a drive device, and a control unit. A discharge member gives an inertial force to a liquid material inside a liquid chamber, thereby discharging the liquid material from a plurality of discharge ports at the same time and forming a plurality of droplets on an application object. The plurality of discharge ports are arranged in a nozzle along a straight nozzle arrangement line, and the nozzle arrangement line is aligned with a drawing direction in which a drawing line is to be drawn. The application device performs the line-drawing application by discharging the liquid material such that a plurality of liquid masses discharged from the plurality of discharge ports do not contact with each other prior to landing on the application object, and that the liquid material having landed along the nozzle arrangement line join together on the application object.

13 Claims, 13 Drawing Sheets

(52) U.S. Cl.
CPC ..... *B05C 5/0237* (2013.01); *B05C 13/00* (2013.01); *B05D 1/26* (2013.01)

(56) References Cited

U.S. PATENT DOCUMENTS

| | | | | |
|---|---|---|---|---|
| 6,267,266 | B1 | 7/2001 | Smith et al. | |
| 6,484,885 | B1 | 11/2002 | Lilie et al. | |
| 6,599,582 | B2 | 7/2003 | Kiguchi et al. | |
| 6,660,332 | B2 | 12/2003 | Kawase et al. | |
| 6,877,853 | B2 | 4/2005 | Kiguchi et al. | |
| 6,939,407 | B2 | 9/2005 | Kawase et al. | |
| 7,114,802 | B2 | 10/2006 | Kiguchi et al. | |
| 7,762,088 | B2 | 7/2010 | Fiske et al. | |
| 8,074,467 | B2 | 12/2011 | Fiske et al. | |
| 8,181,468 | B2 | 5/2012 | Fiske et al. | |
| 8,578,729 | B2 | 11/2013 | Fiske et al. | |
| 2002/0067400 | A1 | 6/2002 | Kawase et al. | |
| 2003/0003231 | A1* | 1/2003 | Kiguchi | H01L 21/288 427/282 |
| 2003/0121836 | A1 | 7/2003 | Lilie et al. | |
| 2004/0004643 | A1* | 1/2004 | Satomura | B41J 2/04506 347/9 |
| 2004/0032480 | A1 | 2/2004 | Kawase et al. | |
| 2004/0048001 | A1 | 3/2004 | Kiguchi et al. | |
| 2004/0100610 | A1 | 5/2004 | Kawase et al. | |
| 2004/0246298 | A1* | 12/2004 | Ito | B41J 2/15 347/40 |
| 2005/0067438 | A1 | 3/2005 | Ikushima | |
| 2005/0083381 | A1* | 4/2005 | Sheinman | B41J 2/025 347/73 |
| 2005/0146588 | A1 | 7/2005 | Kiguchi et al. | |
| 2006/0157517 | A1 | 7/2006 | Fiske et al. | |
| 2007/0145164 | A1* | 6/2007 | Ahmadi | B05C 5/0275 239/583 |
| 2010/0156970 | A1* | 6/2010 | Ikushima | B05B 12/06 347/8 |
| 2010/0220131 | A1 | 9/2010 | Mataki | |
| 2010/0252576 | A1 | 10/2010 | Fiske et al. | |
| 2011/0114673 | A1 | 5/2011 | Fiske et al. | |
| 2012/0097097 | A1 | 4/2012 | Ikushima | |
| 2012/0205392 | A1 | 8/2012 | Fiske et al. | |
| 2013/0201240 | A1* | 8/2013 | Kodama | H05K 3/125 347/14 |
| 2013/0313745 | A1* | 11/2013 | Ikushima | B29C 70/68 264/40.1 |
| 2015/0138272 | A1* | 5/2015 | Campillo | B41J 2/16505 347/29 |

FOREIGN PATENT DOCUMENTS

| | | | |
|---|---|---|---|
| JP | 11-204529 | A | 7/1999 |
| JP | 2001500962 | A | 1/2001 |
| JP | 2003-190871 | A | 7/2003 |
| JP | 2004-004803 | A | 1/2004 |
| JP | 2005-296700 | A | 10/2005 |
| JP | 2007-167844 | A | 7/2007 |
| JP | 2014-37115 | A | 2/2014 |
| WO | 2005/009627 | A2 | 2/2005 |

OTHER PUBLICATIONS

Translation of International Preliminary Report on Patentability (Form PCT/IPEA/409) issued in counterpart International Application No. PCT/JP2015/056800. (4 pages).
Office Action dated Jan. 24, 2019, issued in counterpart CN Application No. 201580013122.7, with English translation. (24 pages).
Supplementary European Search Report dated Sep. 19, 2017, issued in counterpart European Application No. 15761373.8. (1 page).

* cited by examiner (a)

(b)

(a)

(b)

APPLICATION DEVICE AND APPLICATION METHOD

TECHNICAL FIELD

The present invention relates to an application device and an application method, the application device including a plurality of discharge ports arrayed along a straight line.

BACKGROUND ART

A discharge device (dispenser) for discharging a liquid material with the aid of a reciprocating plunger is known as a device to distribute the liquid material in steps of manufacturing electronic parts, etc. The discharge device is used, for example, to perform a desired application of the liquid material on a workpiece while the workpiece is horizontally moved relative to a worktable.

In one example of a related-art discharge device of the type causing the liquid material to land on the workpiece after having departed from a nozzle, a plunger rod is disposed within a flow path including a valve seat near an outlet that is communicated with the nozzle while a lateral surface of the plunger rod is held in a noncontact state, and a tip of the plunger rod is moved toward the valve seat to be impinged against the valve seat, whereupon the liquid material is discharged from the nozzle in a droplet state (Patent Document 1).

As to techniques of discharging the liquid material to fly in the form of droplets by abruptly stopping a plunger, which is moved forward at a fast speed, without impinging the plunger against a valve seat, the applicant has proposed a method and a device for discharging the liquid material in which a liquid-material discharging plunger having a tip surface held in close contact with the liquid material is moved forward at a fast speed, and a plunger driving means is then abruptly stopped to apply an inertial force to the liquid material, thereby discharging the liquid material (Patent Documents 2 and 3).

Furthermore, there is proposed a jetting dispenser including a jetting nozzle provided with a plurality of nozzle outlets in communication with a fluid channel outlet, and a valve member movably disposed within a fluid channel to be able to selectively contact a valve seat, wherein when the valve member comes into contact with the valve seat, a momentum sufficient to quickly jet a plurality of droplets from the plurality of nozzle outlets at the same time is given to the liquid material in the fluid channel outlet (Patent Document 4).

CITATION LIST

Patent Documents

Patent Document 1: Japanese National Publication of International Patent Application No. 2001-500962

Patent Document 2: Japanese Patent Laid-Open Publication No. 2003-190871

Patent Document 3: Japanese Patent Laid-Open Publication No. 2005-296700

Patent Document 4: Japanese Patent Laid-Open Publication No. 2007-167844

SUMMARY OF INVENTION

Technical Problem

From the viewpoint of cutting manufacturing costs of electronic devices, etc., it is demanded to increase the speed of a line-drawing application.

The jetting dispenser disclosed in Patent Document 4 includes the nozzle provided with the plurality of discharge ports. However, the disclosed jetting dispenser is mainly based on a situation of forming a flux layer, and Patent Document 4 includes no suggestions regarding the procedures for carrying out the line-drawing application. Furthermore, Patent Document 4 aims to realize high quality by slowing down an operating speed of the dispenser (see paragraph [0007] in Patent Document 4). It can be hence said that Patent Document 4 does not provide a technique contributable to increasing the speed of the line-drawing application.

An object of the present invention is to provide an application device and an application method, which can increase the speed of the line-drawing application.

Solution to Problem

The present invention provides an application method of drawing a drawing line on an application object with a line-drawing application using an application device, the application device comprising a discharge device, a worktable on which the application object is placed, a drive device for relatively moving the discharge device and the worktable, and a control unit for controlling operations of the discharge device and the drive device, the discharge device comprising a nozzle having a plurality of discharge ports through which a liquid material is discharged, a liquid chamber in communication with the plurality of discharge ports through a plurality of discharge flow paths, and a discharge member contacting the liquid material inside the liquid chamber, wherein the application method includes steps of operating the discharge member to give an inertial force to the liquid material inside the liquid chamber, thereby discharging the liquid material from the plurality of discharge ports at the same time and forming a plurality of droplets on the application object, arranging the plurality of discharge ports in the nozzle along a nozzle arrangement line that is a straight line, aligning the nozzle arrangement line with a drawing direction in which the drawing line is to be drawn, and performing the line-drawing application by discharging the liquid material such that a plurality of liquid masses discharged from the plurality of discharge ports do not contact with each other prior to landing on the application object, and that the liquid material having landed along the nozzle arrangement line join together on the application object.

In the above application method according to the present invention, the control unit may perform the line-drawing application through a step of, in a state of relatively moving the discharge device and the worktable in the same direction as the nozzle arrangement line while keeping a constant speed $V_c$, setting discharge timing to a constant interval $T_c$ on the basis of the relative moving speed between the discharge device and the worktable such that at least one of the plurality of discharged liquid masses joins with the liquid material just previously discharged onto the application object, thus forming the drawing line.

In the above application method according to the present invention, a propulsion force of the discharge member may be adjusted to discharge the liquid material such that the plurality of discharged liquid masses do not contact with each other prior to the landing on the application object, and that the liquid material having landed along the nozzle arrangement line join together on the application object.

In the above application method according to the present invention, the plurality of discharge flow paths may be arranged to incline such that respective center axes of the plurality of discharge flow paths intersect a center axis of the nozzle, and a distance between the droplets may be adjusted by controlling a distance h between the discharge ports and the application object.

In the above application method according to the present invention, the plurality of discharge ports may be all arranged to lie on the nozzle arrangement line.

In the above application method according to the present invention, all of the plurality of discharge ports may have the same shape and may be arranged at a uniform pitch.

In the above application method according to the present invention, the plurality of discharge ports may be an even number of discharge ports and may include two large-sized discharge ports and two small-sized discharge ports, all of the discharge ports being arranged to lie on the nozzle arrangement line, and the small-sized discharge ports and the large-sized discharge ports may be alternately arranged along the nozzle arrangement line. As an alternative, the plurality of discharge ports may be an even number of discharge ports and may include two large-sized discharge ports and two small-sized discharge port groups, all of the large-sized discharge ports being arranged to lie on the nozzle arrangement line, the small-sized discharge port groups and the large-sized discharge ports may be alternately arranged along the nozzle arrangement line, and the small-sized discharge port groups may be each made up of a plurality of small-sized discharge ports that are arranged symmetrically with respect to the nozzle arrangement line.

In the above application method according to the present invention, the discharge device or the worktable may include a rotation mechanism, and the nozzle arrangement line may be aligned, by the rotation mechanism, with the drawing direction in which the drawing line is to be drawn. In this connection, preferably, the line-drawing application is performed in accordance with an application pattern that includes a straight application line extending in a first direction and a straight application line extending in a second direction different from the first direction.

In the above application method according to the present invention, the nozzle may be detachably fixed to the discharge device, and the discharge device may include a positioning mechanism capable of mounting the nozzle such that a direction of the nozzle arrangement line is held constant relative to the discharge device.

The present invention provides an application device comprising a discharge device, a worktable on which an application object is placed, a drive device for relatively moving the discharge device and the worktable, and a control unit for controlling operations of the discharge device and the drive device, the discharge device comprising a nozzle having a plurality of discharge ports through which a liquid material is discharged, a liquid chamber in communication with the plurality of discharge ports through a plurality of discharge flow paths, and a discharge member contacting the liquid material inside the liquid chamber, wherein the discharge device operates the discharge member to give an inertial force to the liquid material inside the liquid chamber, thereby discharging the liquid material from the plurality of discharge ports at the same time and forming a plurality of droplets on the application object, the plurality of discharge ports are arranged in the nozzle along a nozzle arrangement line that is a straight line, and the control unit performs a line-drawing application by discharging the liquid material in a state where the nozzle arrangement line is aligned with a drawing direction in which a drawing line is to be drawn, such that a plurality of liquid masses discharged from the plurality of discharge ports do not contact with each other prior to landing on the application object, and that the liquid material having landed along the nozzle arrangement line join together on the application object.

In the above application device according to the present invention, the control unit may perform the line-drawing application by, in a state of relatively moving the discharge device and the worktable in the same direction as the nozzle arrangement line while keeping a constant speed $V_c$, setting discharge timing to a constant interval $T_c$ on the basis of the relative moving speed between the discharge device and the worktable such that at least one of the plurality of discharged liquid masses joins with the liquid material just previously discharged onto the application object, thus forming the drawing line.

In the above application device according to the present invention, the control unit may adjust a propulsion force of the discharge member to discharge the liquid material such that the plurality of discharged liquid masses do not contact with each other prior to the landing on the application object, and that the liquid material having landed along the nozzle arrangement line join together on the application object.

In the above application device according to the present invention, the plurality of discharge flow paths may be arranged to incline such that respective center axes of the plurality of discharge flow paths intersect a center axis of the nozzle.

In the above application device according to the present invention, the plurality of discharge ports may be all arranged to lie on the nozzle arrangement line.

In the above application device according to the present invention, all of the plurality of discharge ports may have the same shape and may be arranged at a uniform pitch.

In the above application device according to the present invention, the plurality of discharge ports may be an even number of discharge ports and may include two large-sized discharge ports and two small-sized discharge ports, all of the discharge ports being arranged to lie on the nozzle arrangement line, and the small-sized discharge ports and the large-sized discharge ports may be alternately arranged along the nozzle arrangement line. As an alternative, the plurality of discharge ports may be an even number of discharge ports and may include two large-sized discharge ports and two small-sized discharge port groups, all of the large-sized discharge ports being arranged to lie on the nozzle arrangement line, the small-sized discharge port groups and the large-sized discharge ports may be alternately arranged along the nozzle arrangement line, and the small-sized discharge port groups may be each made up of a plurality of small-sized discharge ports that are arranged symmetrically with respect to the nozzle arrangement line.

In the above application device according to the present invention, the discharge device or the worktable may include a rotation mechanism, and the control unit may control the rotation mechanism to make the nozzle arrangement line aligned with the drawing direction in which the drawing line is to be drawn.

In the above application device according to the present invention, the drive device may include a uniaxial drive device capable of relatively moving the discharge device and the worktable in linear motion, and the nozzle arrangement line may be arranged in alignment with a driving direction of the uniaxial drive device.

In the above application device according to the present invention, the nozzle may be detachably fixed to the discharge device, and the discharge device may include a positioning mechanism capable of mounting the nozzle such that a direction of the nozzle arrangement line is held constant relative to the discharge device.

In the above application device according to the present invention, the discharge device may comprise a plunger having a smaller diameter than the liquid chamber and including a tip portion that is moved forward and backward within the liquid chamber, a plunger reciprocating device for moving the plunger forward and backward, and a liquid feed device for supplying the liquid material to the liquid chamber, wherein the liquid material may be discharged from the plurality of discharge ports at the same time by moving the plunger forward and stopping the forward movement of the plunger in a state that a lateral surface of the tip portion of the plunger is not contacted with an inner side wall of the liquid chamber, thus giving an inertial force to the liquid material.

Advantageous Effect of Invention

With the present invention, the speed of the line-drawing application can be increased.

Furthermore, discharge amount accuracy and discharge position accuracy can be improved by performing the line-drawing application with discharge timing set to a constant interval $T_c$.

Moreover, with the present invention in which a discharge flow path is inclined, a distance between the droplets discharged at the same time can be adjusted by adjusting the distance between the discharge ports and the application object.

DESCRIPTION OF EMBODIMENTS

Embodiments of the present invention will be described below with reference to the drawings.

First Embodiment

<Discharge Device>

Figure 1:
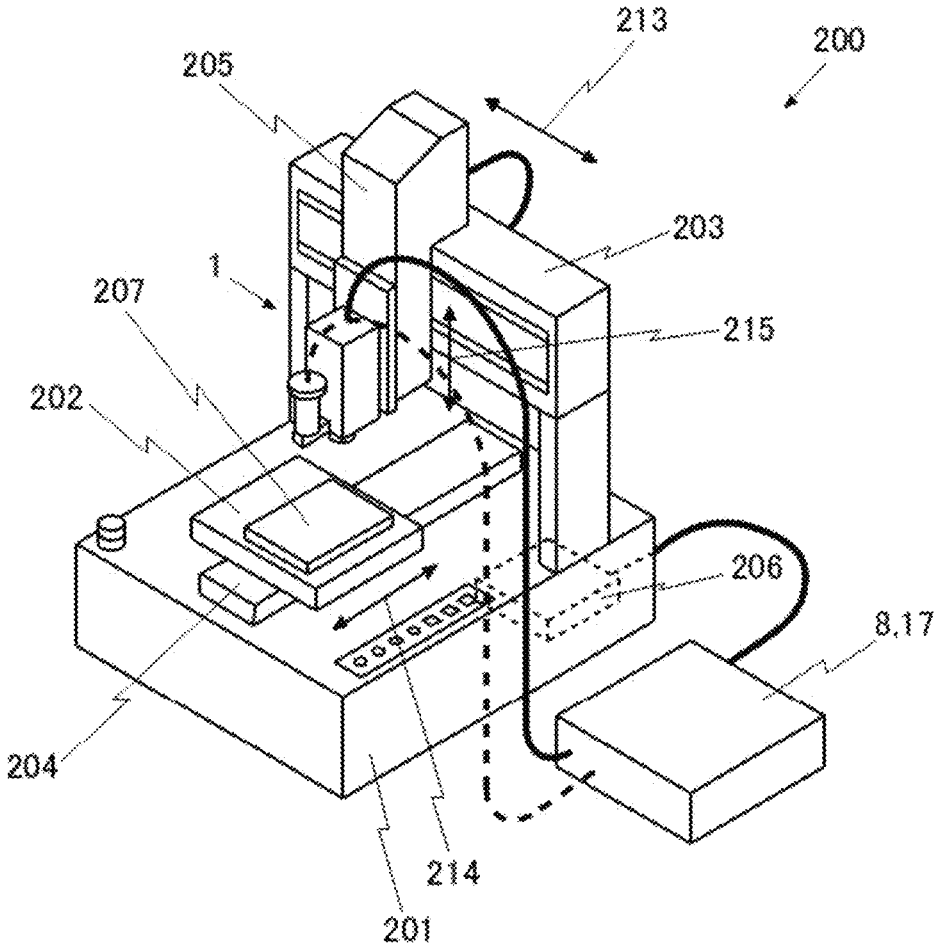
FIG. 1 is a perspective view of an application device of a first embodiment.

As illustrated in FIG. 1, an application device 200 of the first embodiment includes a discharge device 1, a bench 201, a worktable 202 on which an application object 207 is placed, an X drive device 203 for relatively moving the discharge device and the worktable in an X-direction, a Y drive device 204 for relatively moving the discharge device and the worktable in a Y-direction, a Z drive device 205 for relatively moving the discharge device and the worktable in a Z-direction, and a control device 206 for controlling operations of the discharge device 1 and the XYZ drive devices (203, 204 and 205).

It is assumed here that the X-direction represents one direction in a plane, the Y-direction represents a direction perpendicular to the X-direction in the plane, and the Z-direction represents a direction perpendicular to the plane.

While, in this embodiment, the X drive device and the Y drive device are moved in a horizontal direction and the Z drive device is moved in a vertical direction, those drive devices may be driven in other directions. All of the X drive device, the Y drive device, and the Z drive device are not always required. For example, when an application pattern is made of only a straight line extending in one direction, an application intended in the present invention can be performed with provision of only the drive device (only the X drive device or the Y drive device) that is moved in one direction.

<Discharge Device>

Figure 2:
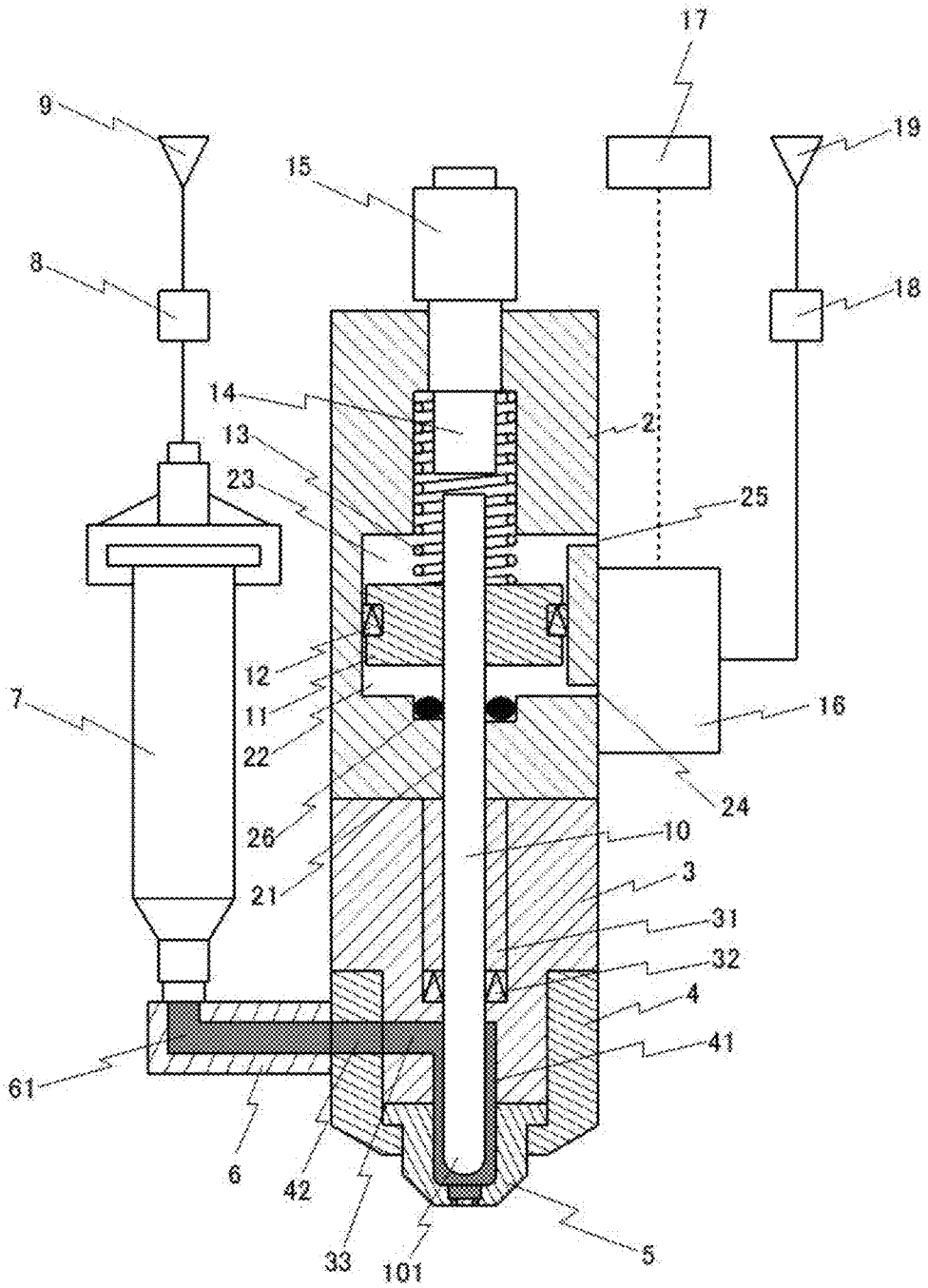
FIG. 2 is a side sectional view of an application device of principal part of a discharge device in the first embodiment.

As illustrated in FIG. 2, a body of the discharge device 1 is constituted by a body upper portion 2 and a body lower portion 3.

The body upper portion 2 includes a through-bore 21 and a piston chamber (22 and 23) penetrating through a center region. A plunger 10 is inserted in the through-bore 21 and the piston chamber. The plunger 10 is an elongate cylindrical rod and penetrates through a piston 11. The piston 11 is a disk-shaped member with an annular sealing member 12 disposed over a lateral peripheral surface. The piston 11 partitions the piston chamber, having a cylindrical shape, into a lower chamber 22 and an upper chamber 23 in an airtight manner, and it slides up and down inside the piston chamber. The piston 11 is coupled to the plunger 10 in such a manner that as the piston 11 is moved up and down, the plunger 10 is also moved up and down. In the following description, the downward movement of the plunger 10 is called forward movement, and the upward movement of the plunger 10 is called backward movement in some cases.

The piston 11 is biased downward by an elastic member 13 that is disposed in the upper chamber 23. A lower communication port 24 in communication with a solenoid switching valve 16 is formed in a lateral surface of the lower chamber 22, and an annular sealing member 26 through which the plunger 10 is inserted is disposed in a bottom surface of the lower chamber 22. The solenoid switching valve 16 is operated to selectively take a first position at which the lower communication port 24 is communicated with an air supply source 19, and a second position at which the lower communication port 24 is communicated with ambient air. When the solenoid switching valve 16 is at the first position, pressurized air supplied from the air supply source 19 is introduced to lower communication port 24 through a regulator 18, whereupon a plunger tip surface 103 is moved away from a bottom surface 412 of the liquid chamber. When the solenoid switching valve 16 is at the second position, the piston 11 is moved downward by a biasing force of the elastic member 13, and the plunger 10 is moved forward with the downward movement of the piston 11. As a result, the plunger tip surface 103 is seated against the bottom surface 412 of the liquid chamber, whereupon a liquid material inside the liquid chamber is given with a propulsion force by the plunger 10 and is discharged from discharge ports (51 and 52).

As an alternative configuration, the forward movement of the plunger 10 may be stopped immediately before the plunger tip surface 103 is seated against the bottom surface 412 of the liquid chamber, thus giving a propulsion force to the liquid material inside the liquid chamber and discharging the liquid material. A discharge device of the type discharging a droplet without causing the plunger tip surface to be seated against any surface is disclosed, for example, in WO2008/108097 and Japanese Patent Laid-Open Publication No. 2013-081884 both filed by the applicant.

While the embodiment has been described above, by way of example, in connection with the case of using the plunger 10 as a discharge member for giving an inertial force to the liquid material inside the liquid chamber, the discharge member is not limited to the plunger. Examples of the discharge member in the present invention include mechanisms for generating pressure in the liquid chamber in communication with the discharge ports, such as a movable valve member, an electrostatic or piezoelectric actuator, a diaphragm, a forcedly deforming means (e.g., a hitting hammer, a combination of a solenoid or the like and a rod, or a high-pressure fluid), and a bubble generating heater.

The liquid material is successively discharged with a lower tip portion 101 of the plunger 10 being operated to repeatedly move forward and backward inside the liquid chamber. During the forward and backward movement of the plunger 10, a lateral surface 102 of the tip portion of the plunger is kept in a state not contacting an inner side wall 411 of the liquid chamber (see FIG. 3(*b*)). While, in this embodiment, the plunger tip surface 103 has a semispherical shape, the shape of the plunger tip surface 103 is not limited to such an example. As an alternative example, the plunger tip surface 103 may be a flat surface, or a flat surface including projections formed concentrically with the discharge ports in the same number as the discharge ports.

A position until which the plunger 10 is movable backward is specified by a stopper 14. A position of the stopper 14 can be adjusted by rotating a micrometer 15.

The body lower portion 3 is joined to a lower end of the body upper portion 2. The body lower portion 3 includes a through-bore 31 penetrating through a center region. The plunger 10 is inserted in the through-bore 31. The through-bore 31 is communicated with the liquid chamber 41. However, because an annular sealing member 32 is disposed at a lower end of the through-bore 31, the liquid material inside the liquid chamber is prevented from reversely flowing into the through-bore 31. The liquid chamber 41 is a cylindrical space extending in the up-down direction, and is communicated in its upper portion with a supply path 33 through which the liquid material is supplied. The supply path 33 is communicated with a liquid feed path 61 in a liquid feed member 6 through a liquid feed path 42 that is formed in a mounting member 4. In this embodiment, the supply path 33, the liquid feed path 42, and the liquid feed path 61 are formed to extend horizontally. It is, however, of course possible that those paths are formed to incline at a certain angle.

Figure 3:
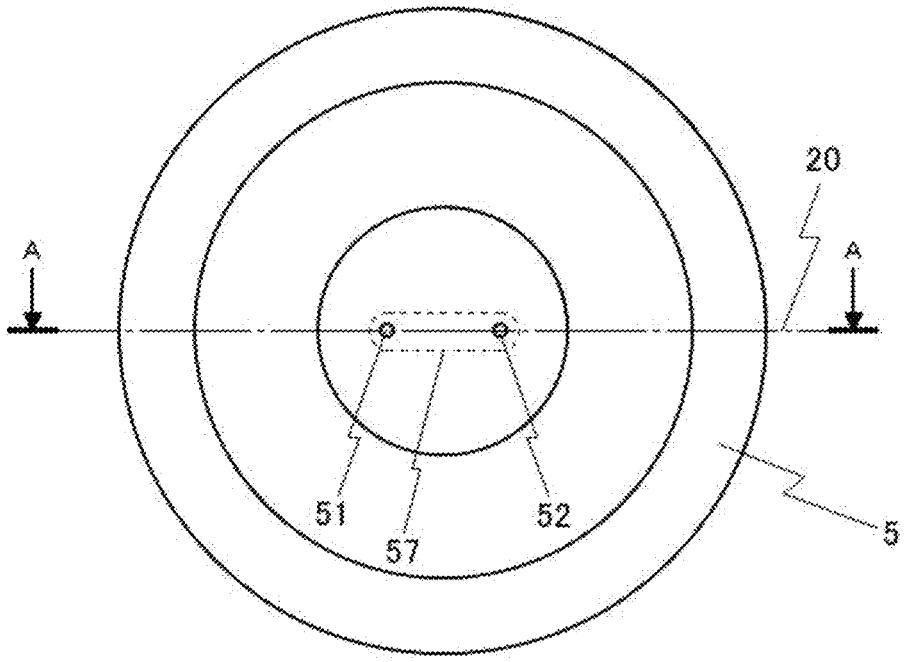
FIGS. 3(*a*) and 3(*b*) are respectively a bottom view and a side sectional view of a nozzle member in the first embodiment.
Figure 3:
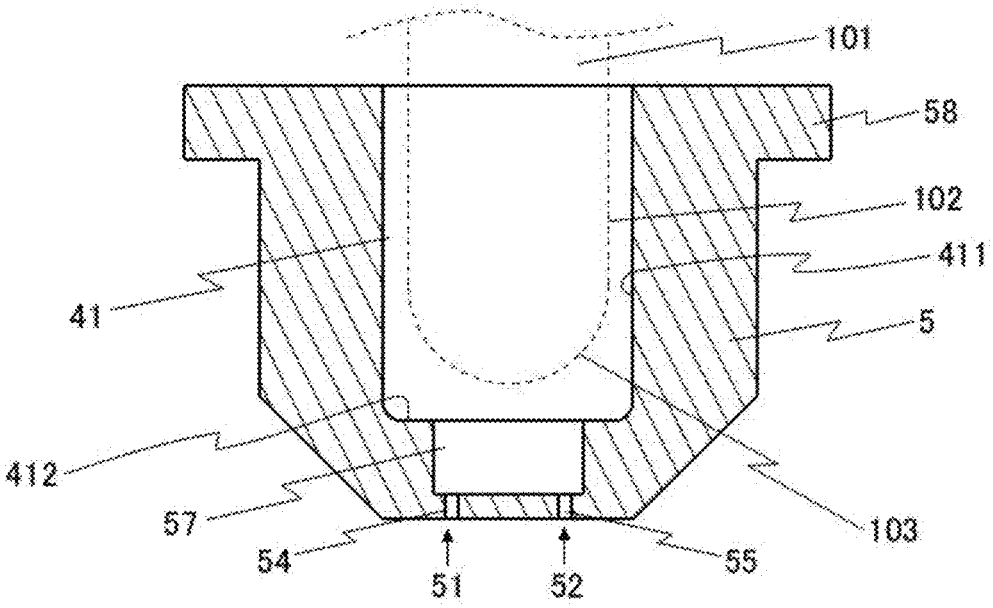

As illustrated in FIG. 3(*a*), a nozzle member 5 has a first discharge port 51 and a second discharge port 52 both formed to lie on a nozzle arrangement line 20 that is a straight line, and having circular shapes with the same diameter. A diameter $D_1$ of each of the first discharge port 51 and the second discharge port 52 is, for example, several μm to several mm and preferably several tens μm to several hundred μm. The shape of the first discharge port 51 and the second discharge port 52 is not limited to the illustrated circular shape. It is disclosed here that, in another example, each discharge port may have an elliptic shape elongate along the nozzle arrangement line 20. The shapes and an arrangement pattern of the plurality of discharge ports are preferably symmetrical with respect to the nozzle arrangement line 20. That point is similarly applied to the case where a lower end of the nozzle member 5 has a shape not being flat, but being uneven.

A closest distance $L_1$ between the first discharge port 51 and the second discharge port 52 (i.e., a distance between a right end of the first discharge port 51 and a left end of the second discharge port 52) is set larger than the diameter $D_1$ in any cases, and it is set to be, e.g., 2 to 10 times the diameter $D_1$. In other words, the distance $L_1$ is a distance ensuring that, when the plurality of discharge ports are arranged in the nozzle member along the straight nozzle arrangement line, the droplets of the liquid material having landed on the application object join together to form an application line.

When the discharge device 1 is mounted to the application device 200, the nozzle arrangement line 20 is arranged to be aligned with a drawing direction in which a drawing line is to be drawn. The worktable 202 or the discharge device 1 may include a rotation mechanism rotating in a θ-direction (rotating direction about a vertical line relative to the worktable) such that the nozzle arrangement line 20 can be dynamically aligned with the drawing direction in which the drawing line is to be drawn. Here, the expression "the nozzle arrangement line 20 is aligned with the drawing direction in which the drawing line is to be drawn" implies that when the nozzle arrangement line is projected onto the drawing line, both directions of the drawing line and the nozzle arrangement line are aligned with each other, or that when the nozzle arrangement line 20 and the drawing line are normally projected onto a plane perpendicular to a direction in which the liquid material is discharged, both directions of the nozzle arrangement line 20 and the drawing line are aligned with each other. Stated in still another way, the above expression implies that the drawing line exists in a plane including the discharge direction of the liquid material discharged from the discharge ports. Such a point can be similarly applied to the case where a surface of the application object is not planar or it is inclined.

To say more exactly, the discharge direction of the liquid material in this embodiment implies the discharge direction of the liquid material when the liquid material is discharged in a state of the relative movement between the worktable and the discharge device being stopped. In the case where the discharge direction of the liquid material is aligned with the vertical direction as in this embodiment, a line perpendicular to the discharge direction of the liquid material is a line on a horizontal plane.

On the other hand, when the application pattern is made up of a plurality of straight lines including one or more bent points, it is essential that the worktable 202 or the Z-axis drive device 205 includes the rotation mechanism rotating in the θ-direction. For example, when the application pattern has a rectangular shape and one apex of the rectangular shape serves as an application start point and an application end point, there are three bent points. The rotation mechanism can be constituted by employing, e.g., a known servomotor.

When the application pattern includes a linear portion, the application object is placed on the worktable 202 in such a state that an extending direction of the linear portion is aligned with the X-direction or the Y-direction, and that the nozzle arrangement line 20 is oriented in the same direction as the linear portion. As a result, in applying the liquid material to the linear portion, the application can be performed by driving only one of the X drive device 203 and the Y drive device 204, and the application line can be formed with higher accuracy.

In other words, when the XYZ drive devices (203, 204 and 205) include a uniaxial drive device (i.e., the X drive device or the Y drive device) capable of relatively moving the discharge device 1 and the worktable 202 in linear motion, the nozzle arrangement line 20 is preferably arranged to be aligned with a driving direction (X-direction or Y-direction) of the uniaxial drive device. Such an arrangement is particularly effective in the case not including the above-described rotation mechanism.

As illustrated in FIG. 3(*b*), the first discharge port 51 is communicated with the liquid chamber 41 through a first discharge flow path 54 having a small diameter and a discharge flow path 57 having a large diameter. The second discharge port 52 is communicated with the liquid chamber 41 through a second discharge flow path 55 having a small diameter and the large-diameter discharge flow path 57. The first discharge flow path 54 and the second discharge flow path 55 have the same shape and have center axes extending in the vertical direction.

The first discharge flow path 54 and the second discharge flow path 55 may be directly communicated with the liquid chamber 41 without providing the large-diameter discharge flow path 57. As an alternative, the first discharge flow path 54 and the second discharge flow path 55 directly communicating with the liquid chamber 41 may be each constituted by two independent small-diameter flow paths and two independent large-diameter flow paths.

The first discharge port 51 and the second discharge port 52 formed in a flat lower end surface of the nozzle member 5 are opened downward, and the liquid material is dropped from those discharge ports in a state that the lower end surface of the nozzle member 5 is arranged in the horizontal direction (i.e., a direction perpendicular to the discharge direction of the liquid material).

The nozzle member 5 includes a flange 58 at an upper end, and it is supported by the mounting member 4 at the flange 58. The mounting member 4 is detachably fixed, in a state supporting the nozzle member 5, to the body lower portion 3 by threaded engagement or with the aid of fixtures, e.g., screws. Since the nozzle member 5 is detachably mounted by the mounting member 4, the plurality of nozzle members 5 having the discharge ports different in diameters and closest distances can be easily replaced depending on uses. Although a manner of detachably mounting the nozzle member 5 is not limited to particular one, it is preferable to dispose a positioning mechanism capable of mounting the nozzle member 5 such that the direction and the position of the nozzle arrangement line 20 are held constant relative to the discharge device 1. The positioning mechanism can be constituted by suitable one of known positioning mechanisms. For example, the positioning can be implemented by a mechanism of engaging a part (e.g., a pin, a mouth, or a cutout) in one of the nozzle member 5 and a member, which belongs to the body lower portion 3, with a counterpart in the other, or a mechanism using a separately prepared member (e.g., a pin or a screw).

The liquid feed member 6 is fixed to a lateral surface of the mounting member 4. A liquid reservoir 7 is coupled to an upper surface of the liquid feed member 6. The liquid reservoir 7 is supplied with pressurized air from an air supply source 9 through an air-type dispenser 8. The pressurized air supplied from the air supply source 9 may be gas (e.g., nitrogen gas) other than the atmospheric air in some cases.

<XYZ Drive Devices>

The XYZ drive devices (203, 204 and 205) include, for example, a known XYZ-axis servo motor and a known ball screw, and can move the discharge ports (51 and 52) of the discharge device 1 to an arbitrary position on a workpiece at an arbitrary speed. Operations of the XYZ drive devices (203, 204 and 205) are controlled by the control device 206.

<Control Device>

The control device 206 includes a processor, a storage device storing an application program, and an input device. For example, a personal computer or a programmable controller can be used as the control device 206. The control device 206 may be wholly incorporated inside the bench 201 in some cases, and a part of the control device 206 may be installed outside the bench 201 and connected to the remaining part in a wired or wireless way in other cases. The control device 206 receives, from the input device, application control data that include the application pattern, the application reference position, the relative moving speed, the discharge timing, and the speeds of the forward and backward movements of the plunger, and then stores the received data in the storage device. The processor reads the application control data stored in the storage device, and executes an application operation described below.

<Application Operation>

The application operation by the application device 200 is executed as follows, aiming to apply the liquid material in a linear form (i.e., to perform the line-drawing application) in the X-direction, the Y-direction, or an oblique direction (direction forming an angle relative to the X-direction or the Y-direction).

Figure 4:
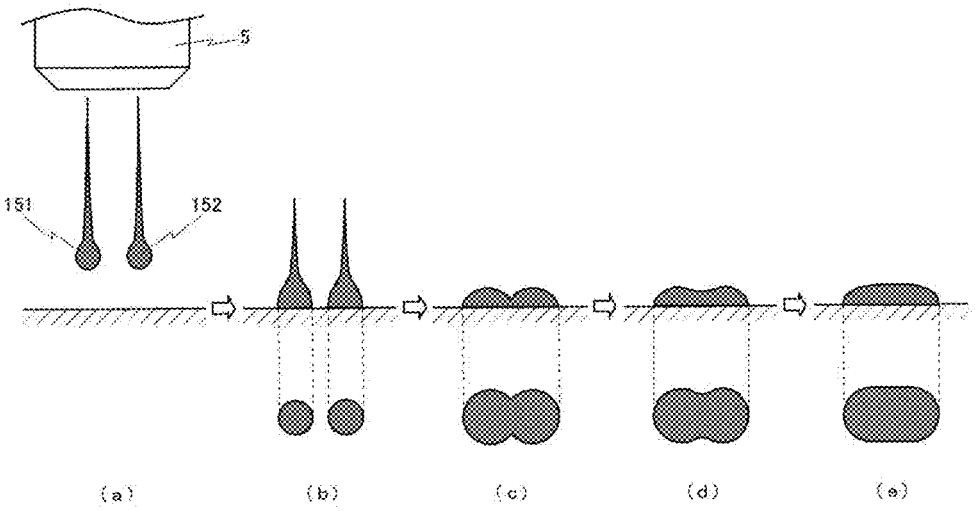
FIG. 4 illustrates one discharge step in the first embodiment; specifically, FIG. 4(*a*) represents timing before discharged droplets land on an application object, FIG. 4(*b*) represents timing at which the discharged droplets have just landed on the application object, FIG. 4(*c*) represents timing after the lapse of a very short time after the landing, FIG. 4(*d*) represents timing after the lapse of a very short time after the timing of FIG. 4(*c*), and FIG. 4(*e*) represents timing after the lapse of a very short time after the timing of FIG. 4(*d*).

FIG. 4(*a*) represents timing before droplets (151 and 152) discharged from the discharge ports (51 and 52) of the nozzle member 5 land on the application object (workpiece). As illustrated in FIG. 4(*a*), the present invention is premised on that the discharged liquid material takes a droplet state on the workpiece. The liquid material discharged from the discharge ports (51 and 52) may form the droplets after having departed from the discharge ports, or may depart from the discharge ports after having contacted the workpiece, and then form the droplets on the application object. In this Description, the liquid materials in a state after being discharged from the discharge ports, but before departing from the discharge ports, and the droplets in a state having departed from the discharge ports after being discharged therefrom, but not yet landing on the workpiece are both called "liquid masses" in some cases.

An application method for forming the droplet on the application object with the liquid material departing from the discharge port after having contacted the workpiece is disclosed, for example, in WO2008/146464 filed by the applicant. In order to make the liquid material depart from the discharge port after having contacted the application object, the discharge operation is preferably performed on condition that a distance $h_1$ between the discharge port and the workpiece is less than several times a height $h_0$ of the liquid material in a state attached to the discharge port (nozzle) before contacting the workpiece. More preferably, the distance $h_1$ between the discharge port and the workpiece is set less than twice the height $h_0$ (i.e., $h_0<h_1<h_0\times2$).

In order to allow two droplets having landed on the application object at close positions to quickly spread and join together, a propulsion force at a certain level or stronger needs to be given to the droplets. As a result of experiments, it has been found that a propulsion force sufficient to ensure quick joining of the droplets after the landing is given to the droplets discharged in a jet-type discharge device of related art.

Figure 6:
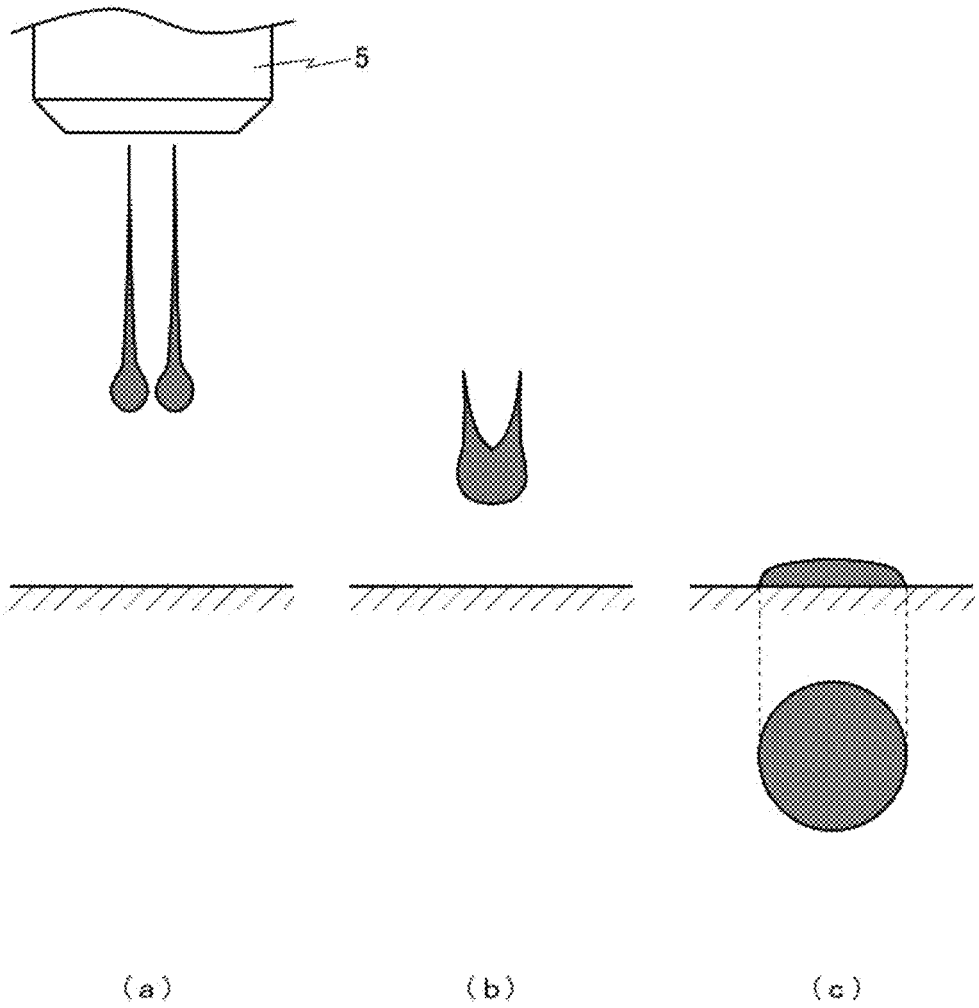
FIG. 6 is a side view referenced to explain the case where two droplet join together while flying; specifically, FIG. 6(*a*) represents timing immediately after discharge of liquid masses, FIG. 6(*b*) represents timing after the lapse of a very short time after the timing of FIG. 6(*a*), and FIG. 6(*c*) represents timing at which the liquid masses discharged at the same time land on the application object.

Another important point in addition to the above point is that a plurality of liquid masses discharged at the same time do not contact with each other or join together prior to the landing. If the droplets contact with each other or join together prior to the landing, the droplet size becomes too large to realize the desired application pattern. In more detail, as illustrated in FIG. 6, if the two droplets join together while flying, the landed droplets have a circular surface. Thus, the line-drawing application cannot be performed unless a droplet having the same size as the joined droplets has to be landed to be partly overlapped with the previously landed droplets (namely, the application operation is substantially the same as that in the case where the discharge device has one discharge port). Conditions for discharging the liquid material such that the plurality of liquid masses discharged from the plurality of discharge ports at the same time do not contact with each other prior to the landing on the application object, and that the liquid masses having landed along the nozzle arrangement line 20 join together on the application object are different depending on work environments, such as the type of the liquid material and the structure of the discharge device. Therefore, optimum conditions need to be found through operations of repeating the discharge while the condition of each of various factors is changed per work environment. Main factors to be taken into consideration in carrying out those operations are, e.g., the distance between the discharge ports, the orifice size of each discharge port, the viscosity of the liquid material, and the magnitude of the propulsion force given to the discharge member (factors other than the above ones can also be of course regulated). Furthermore, as described in a later fifth embodiment, it is also effective to set the condition through adjustment of the distance between the discharge ports and the application object.

FIG. 4(*b*) represents timing at which the liquid masses discharged at the same time have just landed on the application object. As illustrated in FIG. 4(*b*), the liquid materials discharged from the two discharge ports (51 and 52) are in a positional relation not contacted with each other at the timing of the landing. Stated in another way, the liquid material masses discharged from the plurality of discharge ports form the droplets in the same number as the discharge ports and land on the application object in a state not contacted with each other.

FIG. 4(*c*) represents timing after the lapse of a very short time after the landing of the liquid masses, discharged at the same time, on the application object. As illustrated in FIG. 4(*c*), the droplets, each having landed in a circular shape, spread on the application object, and the two circles contact with each other to start joining together.

FIG. 4(*d*) represents timing after the lapse of a very short time after the timing of FIG. 4(*c*). As illustrated in FIG. 4(*d*), the joining of the two circles having contacted with each other further progresses, and recesses formed in the joined two circles in a widthwise direction (i.e., an up-down direction in FIG. 4(*c*)) are shallowed. In other words, unlike the joining of two droplets while flying, the joining of the two droplets on the application object act to form an elongate shape extending in the direction of the nozzle arrangement line 20 (namely, the two droplets do not form a circular shape when viewed from above, even after joining together).

FIG. 4(*e*) represents timing after the lapse of a very short time after the timing of FIG. 4(*d*). As illustrated in FIG. 4(*e*), the two circles completely join together to have a uniform application width, and a linear elongate application pattern extending in the same direction as the nozzle arrangement line 20 is formed.

FIGS. 4(*a*) to 4(*e*) illustrate a step of carrying out the line-drawing application of a predetermined length (minimum unit) by one discharge. An application line of the desired length can be formed by repeating the above step.

Figure 5:
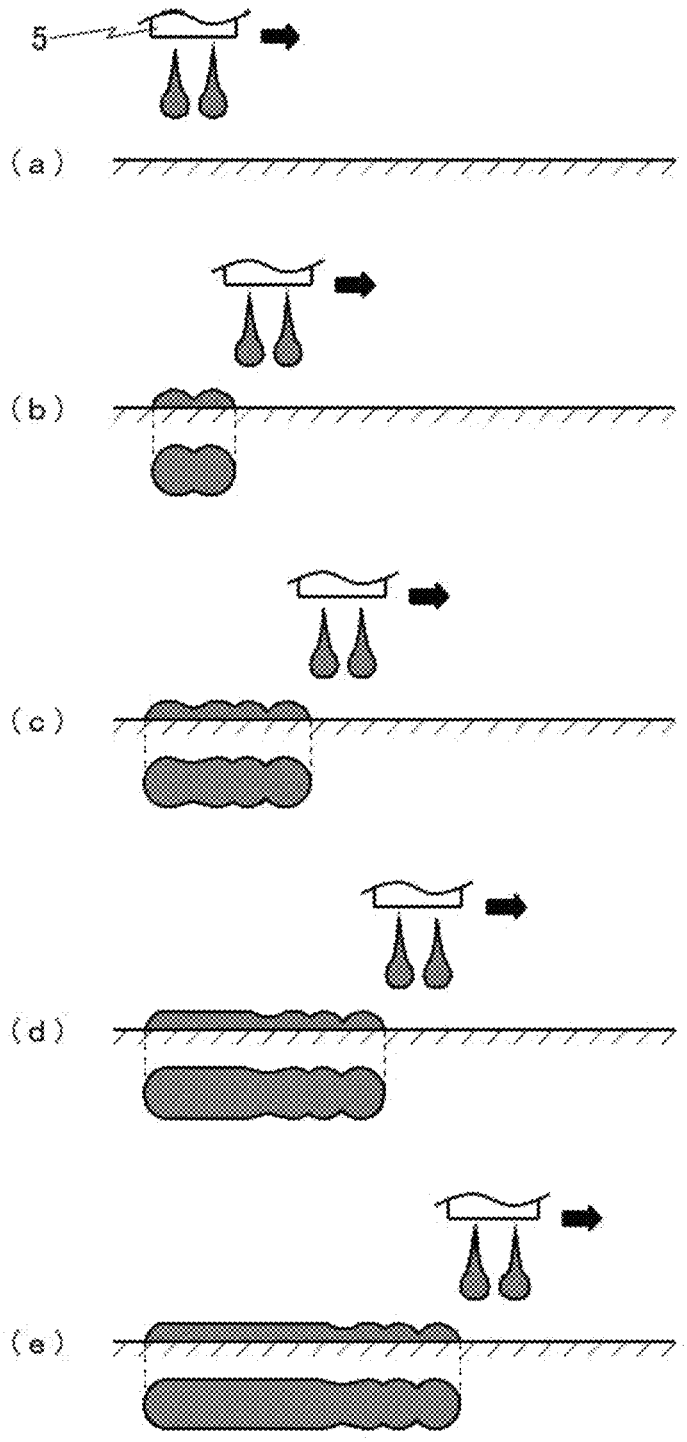
FIG. 5 illustrates a plurality of discharge steps performed by the application device of the first embodiment; specifically, FIG. 5(*a*) illustrates discharged droplets, viewed from side, at timing immediately after the first ejection, FIG. 5(*b*) illustrates the discharged droplets, viewed from side and above, at timing immediately after the second ejection, FIG. 5(*c*) illustrates the discharged droplets, viewed from side and above, at timing immediately after the third ejection, FIG. 5(*d*) illustrates the discharged droplets, viewed from side and above, at timing immediately after the fourth ejection, and FIG. 5(*e*) illustrates the discharged droplets, viewed from side and above, at timing immediately after the fifth ejection.

FIGS. 5(*a*) to 5(*e*) illustrate steps of performing the line-drawing application through a plurality of discharges.

FIG. 5(*a*) illustrates two discharged droplets, viewed from side, at timing immediately after the first ejection.

FIG. 5(*b*) illustrates the discharged droplets, viewed from side and above, at timing immediately after the second ejection. At this timing, the two droplets discharged with the first ejection start joining together on the application object.

FIG. 5(*c*) illustrates the discharged droplets, viewed from side and above, at timing immediately after the third ejection. At this timing, the joining of the two droplets discharged with the first ejection further progresses, and the two droplets discharged with the second ejection start joining together on the application object.

FIG. 5(*d*) illustrates the discharged droplets, viewed from side and above, at timing immediately after the fourth ejection. At this timing, the two droplets discharged with the first ejection completely join together, the joining of the two droplets discharged with the second ejection further progresses, and the two droplets discharged with the third ejection start joining together on the application object.

FIG. 5(*e*) illustrates the discharged droplets, viewed from side and above, at timing immediately after the fifth ejection. At this timing, the droplets discharged with the first and second ejections completely join together, the joining of the two droplets discharged with the third ejection further progresses, and the two droplets discharged with the fourth ejection start joining together on the application object.

Thus, in this embodiment, the desired application line can be formed by repeating the cycle of discharging two liquid masses at the same time. The term "application line" used here includes not only the application line having no unevenness in a widthwise direction of the applied liquid material (i.e., along a side edge of the applied liquid material extending in a lengthwise direction) as illustrated in FIG. 4(*e*), but also the application lines having unevenness in the widthwise direction thereof as illustrated in FIGS. 4(*c*) and 4(*d*). When the viscosity of the liquid material is relatively high, unevenness may remain in the widthwise direction of the application line. However, the object of the application operation may be achieved even with the application line having unevenness in the widthwise direction in some examples, such as the case of applying an adhesive that is collapsed in a bonding step. However, because bubbles may be caused due to the unevenness in the widthwise direction, the discharge is preferably controlled such that an extent of recesses constituting the unevenness is kept not larger than ⅓ of the radius of the droplet after having spread.

It is to be noted that the application line is obtained as not a film formed uniformly on the surface of the application object (workpiece), but a line formed in a state rising from the surface.

The present invention has a significant advantageous effect in enabling the line-drawing application to be performed on condition that the nozzle having the plurality of discharge ports is used and the discharge timing is set to a constant interval $T_c$ while the discharge device and the worktable are relatively moved at a constant speed $V_c$. Stated in another way, in the present invention, the line-drawing application can be performed in a way of controlling the plunger rod so as to repeat a predetermined reciprocating operation while the discharge device and the worktable are relatively moved at a constant speed. As a result of setting the discharge timing to the constant interval $T_c$, a discharge amount of the liquid material is held constant, whereby accuracy of the discharge amount and accuracy of a discharge position are improved. The constant interval $T_c$ is preferably set to such a value that at least one of the plurality of liquid masses discharged from the plurality of discharge ports at the same time joins with the liquid material (landed droplet) just previously discharged onto the application object, thereby forming a linear application pattern. The joining with the liquid material just previously discharged is made at the same time as the landing in some cases, or made after the lapse of a short time after the landing in other cases. The former cases often occur when the just previously discharged liquid material has already spread on the application object.

In one preferable example, the constant interval $T_c$ is set to satisfy such a condition that $V_c \times T_c$ is equal to the distance between the discharge ports adjacent to each other. The reason is as follows. When the constant interval $T_c$ is set to the above distance, a joining state on the application object between a linear portion B formed by the plurality of liquid masses discharged at the present time and joining together and a linear portion A formed by the plurality of liquid masses discharged immediately before the present time and joining together can be made the same as each of a joining state of the plurality of liquid masses constituting the linear portion A and a joining state of the plurality of liquid masses constituting the linear portion B. Hence an advantageous effect of forming a uniform straight line can be expected.

Figure 13:
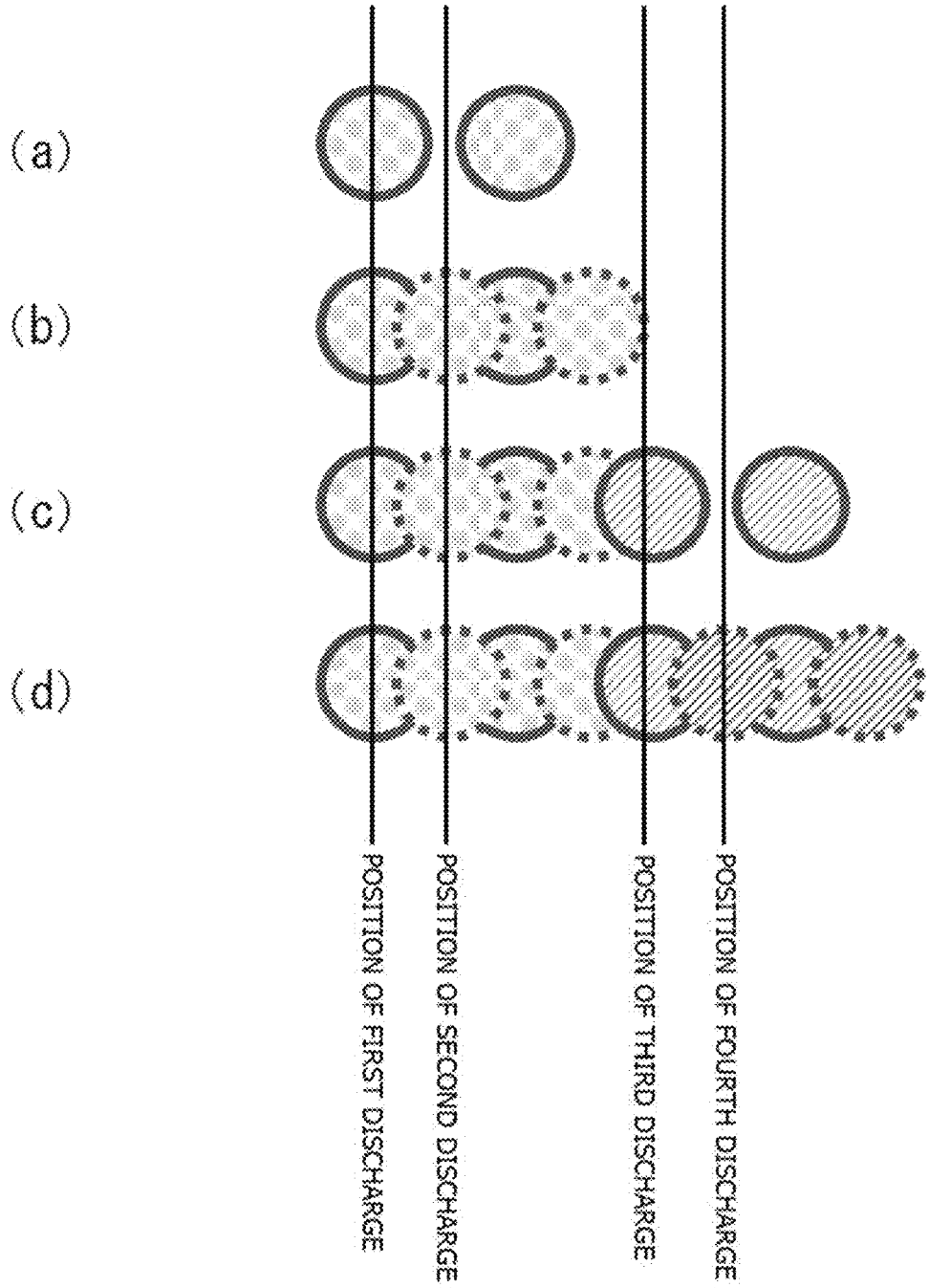
FIG. 13 is an explanatory view referenced to explain an application method in the case where two droplets having landed on the application object do not join together on the application object; specifically, FIG. 13(*a*) represents first discharge, FIG. 13(*b*) represents second discharge, FIG. 13(*c*) represents third discharge, and FIG. 13(*d*) represents fourth discharge.

FIG. 13 is an explanatory view referenced to explain an application method in the case where two droplets having landed on the application object do not join together on the application object. In FIG. 13, a linear line represents a position of the discharge port 51 in each discharge.

Because two droplets (denoted by solid lines and halftone shading) discharged in the first discharge do not join together, other two droplets (denoted by dotted lines and halftone shading) need to be discharged in the second discharge so as to interconnect the two droplets discharged in the first discharge. In the third discharge, two droplets (denoted by solid lines and oblique lines) need to be discharged to overlap one of the droplets, discharged in the second discharge and positioned on the downstream side in a direction in which the discharge proceeds (i.e., on the right side), such that the discharged droplets overlap each other uniformly at all positions. In the fourth discharge, as in the second discharge, the two droplets (denoted by dotted lines and oblique lines) need to be discharged so as to interconnect the two droplets discharged in the third discharge.

Thus, the application method illustrated in FIG. 13 has a problem that, when the discharge device and the worktable are relatively moved at a constant speed, the discharge timing has to be changed. On the other hand, when the relative moving speed between the discharge device and the worktable is changed, another problem arises in that the landed positions of the droplets are difficult to control.

According to the application device and the application method of the first embodiment described above, since the line-drawing application is performed by discharging two liquid masses at the same time, the application speed can be increased about twice in comparison the case of performing the line-drawing application in a manner of discharging droplets one by one to be overlapped with each other. Such a speedup of the line-drawing application is especially advantageous when a straight line is to be drawn. A significant effect with the speedup of the line-drawing application is obtained, for example, in the case where the application pattern is just made up of one or more straight lines.

In addition, a highly-accurate line-drawing application can be realized with the features of employing the nozzle having the plurality of discharge ports, and setting the discharge timing to the constant interval while the discharge device and the worktable are relatively moved at the constant speed.

Second Embodiment

A second embodiment is different from the first embodiment in that the nozzle member 5 of the discharge device 1 has three discharge ports arranged at a uniform pitch, and it is similar to the first embodiment in the other points. In the following, description of common points to those in the first embodiment is omitted, and different points are described.

Figure 7:
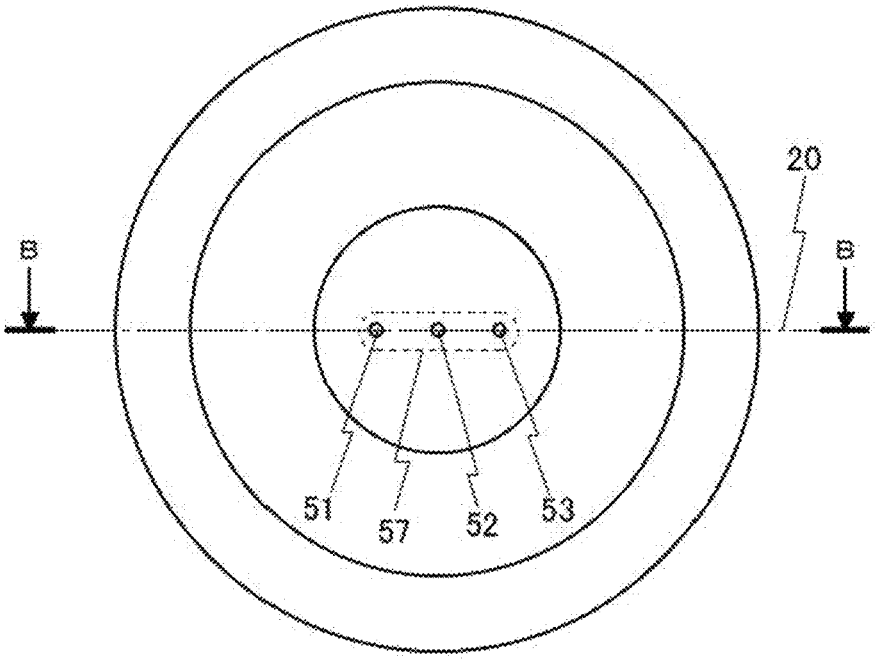
FIGS. 7(*a*) and 7(*b*) are respectively a bottom view and a side sectional view of a nozzle member in a second embodiment.
Figure 7:
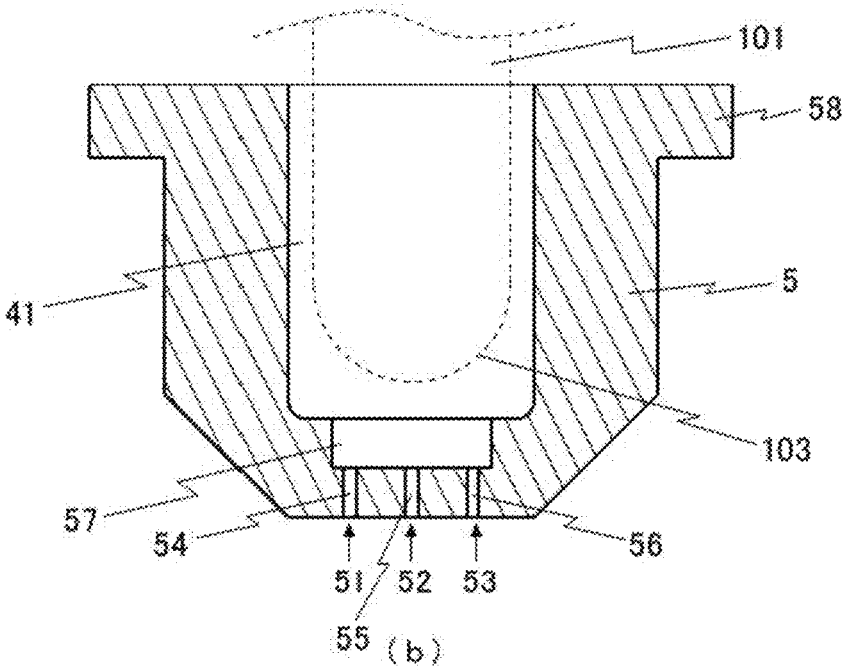

As illustrated in FIG. 7(*a*), the nozzle member 5 has a first discharge port 51, a second discharge port 52, and a third discharge port 53, all of which are formed to lie on the straight nozzle arrangement line 20 and have circular shapes with the same diameter. A diameter $D_1$ of each of the first to third discharge ports (51 to 53) is the same as that in the first embodiment. A closest distance $L_1$ between the first discharge port 51 and the second discharge port 52 (i.e., a distance between a right end of the first discharge port 51 and a left end of the second discharge port 52) is equal to a closest distance $L_2$ between the second discharge port 52 and the third discharge port 53 (i.e., a distance between a right end of the second discharge port 52 and a left end of the third discharge port 53). $L_1$ and $L_2$ are each set larger than the diameter $D_1$ in any cases; namely, they are each set to be, e.g., 2 to 10 times the diameter $D_1$. When the discharge device 1 is mounted to the application device 200, the nozzle arrangement line 20 is arranged to be aligned with a direction in which a desired drawing line (straight line) is to be drawn. As in the first embodiment, the worktable 202 or the discharge device 1 may include a rotation mechanism such that an aligning direction of the discharge ports can be dynamically adjusted by the rotation mechanism.

As illustrated in FIG. 7(*b*), the first to third discharge ports (51 to 53) are communicated with the liquid chamber 41 through a first discharge flow path 54, a second discharge flow path 55, and a third discharge flow path 56, respectively, and through a large-diameter discharge flow path 57. The first to third discharge flow paths (54 to 56) have the same shape and have center axes extending in the vertical direction. In other words, the first to third discharge flow paths (54 to 56) are disposed parallel to the vertical direction.

According to the second embodiment, an application line including a length corresponding to three droplets can be formed by one discharge. While the nozzle member having three discharge ports arranged at a uniform pitch has been disclosed in the second embodiment, similar advantageous effects can also be obtained with a nozzle member including four or more discharge ports having the same shape and arranged at a uniform pitch.

Third Embodiment

A third embodiment is different from the first and second embodiments in that the nozzle member 5 of the discharge device 1 has four discharge ports arranged at a uniform pitch, and it is similar to the first and second embodiments in the other points. In the following, description of common points to those in the first and second embodiments is omitted, and different points are described.

Figure 8:
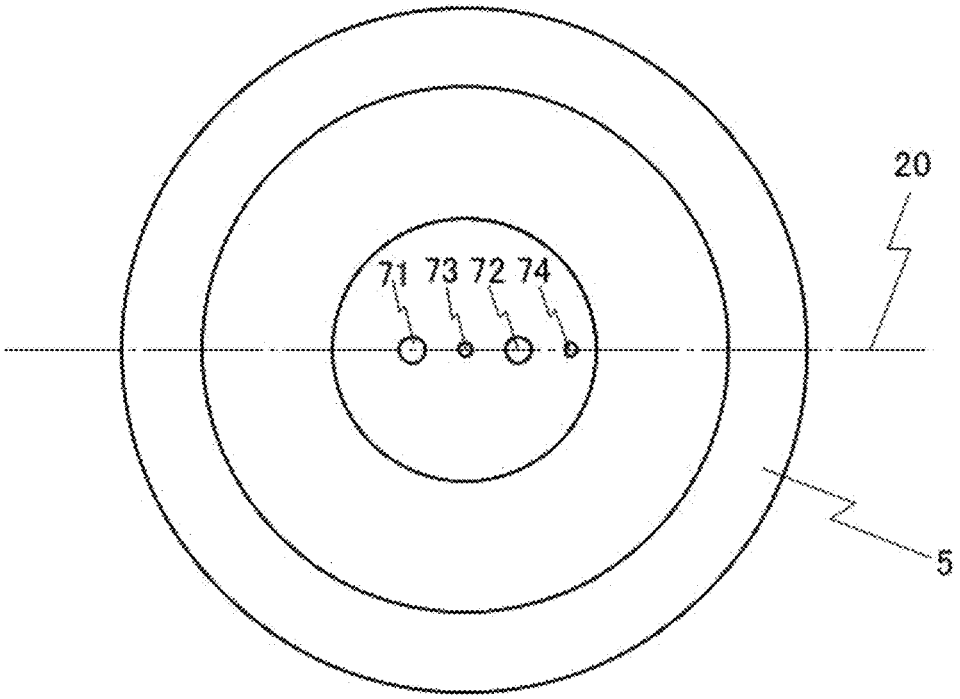
FIG. 8 is a bottom view of a nozzle member in a third embodiment.

As illustrated in FIG. 8, the nozzle member 5 has a first discharge port 71 and a second discharge port 72 each having a large-diameter circular shape, and a third discharge port 73 and a fourth discharge port 74 each having a small-diameter circular shape, which are all formed to lie on the straight nozzle arrangement line 20. A diameter $D_1$ of each of the first discharge port 71 and the second discharge port 72 is, for example, several ten μm to several mm. A diameter $D_2$ of each of the third discharge port 73 and the fourth discharge port 74 is ½ to 1/10 of the diameter $D_1$, and $D_2$ is, for example, several μm to several hundred μm. The large-diameter circular discharge ports and the small-diameter circular discharge ports are alternately arranged on the nozzle arrangement line 20 at substantially equal intervals.

The third discharge port 73 is arranged at a midpoint of a closest distance $L_1$ between the first discharge port 71 and the second discharge port 72 (i.e., a distance between a right end of the first discharge port 71 and a left end of the second discharge port 72). A closest distance $L_2$ between the first discharge port 71 and the third discharge port 73 is set larger than the diameter $D_1$ in any cases; namely, it is set to be, e.g., 2 to 10 times the diameter $D_1$. The fourth discharge port 74 is arranged in a symmetrical relation to the third discharge port 73 with respect to the second discharge port 72. In other words, a closest distance $L_3$ between the second discharge port 72 and the fourth discharge port 74 is the same as $L_2$. When the discharge device 1 is mounted to the application device 200, the nozzle arrangement line 20 is arranged to be aligned with a direction in which a desired drawing line (straight line) is to be drawn. As in the first embodiment, the worktable 202 or the discharge device 1 may include a rotation mechanism such that an aligning direction of the discharge ports can be dynamically adjusted by the rotation mechanism.

Figure 9:
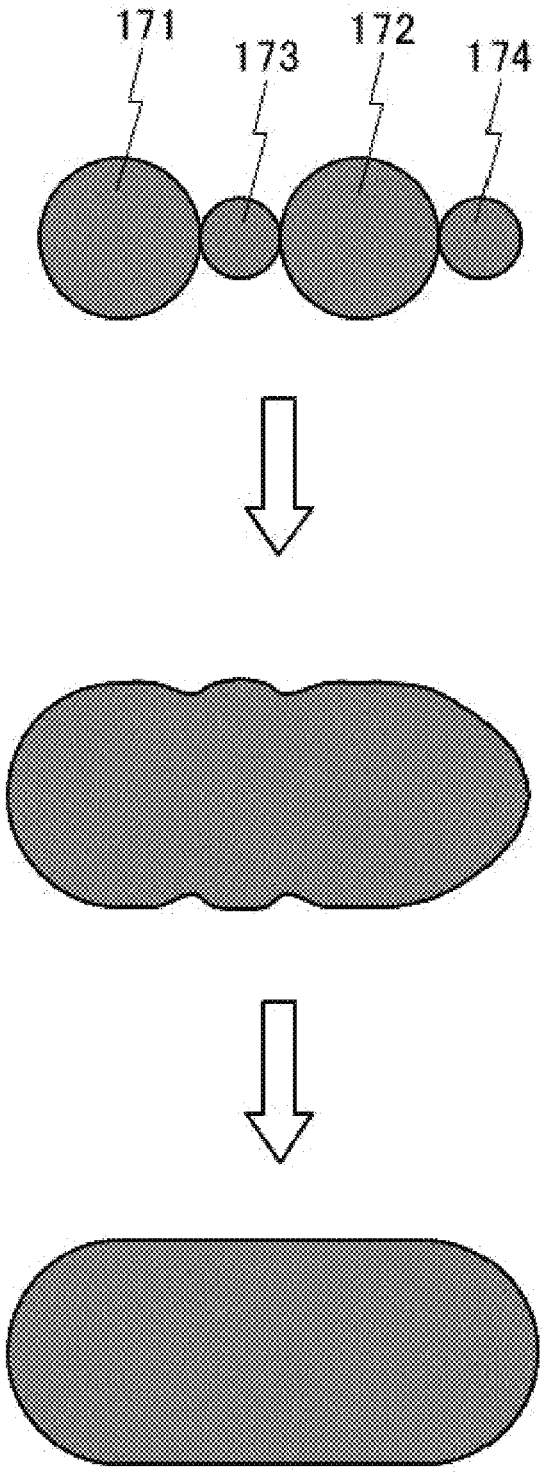
FIG. 9 illustrates an image, viewed from above, representing how four droplets discharged at the same time join together in the third embodiment.

FIG. 9 illustrates an image representing how four liquid masses discharged from the first to fourth discharge ports (71 to 74) at the same time land and spread on the application object. As illustrated in an upper area of FIG. 9, at the time of the landing, four droplets (171 to 174) discharged from the first to fourth discharge ports (71 to 74) at the same time are independent droplets each having a circular shape when viewed from above. As illustrated in a middle area of FIG. 9, after the lapse of a very short time from the landing, the four droplets (171 to 174) spread to start joining together. Here, the two aid droplets 173 and 174 act to promote the joining between the basic droplets 171 and 172. Finally, as illustrated in a lower area of FIG. 9, the four circles completely join together into such a state that an application line has a uniform width and a straight elongate application pattern extending in the same direction as the nozzle arrangement line 20 is formed.

Although each discharge port is preferably formed in a circular shape, the advantageous effects of the present invention can also be obtained with the discharge port having a shape other than the circular shape. When the discharge ports are each made up of a plurality of holes having different sizes, at least the respective largest holes of the discharge ports are preferably formed in the same shape and in the same size. More preferably, the discharge ports made up of a plurality of holes having different sizes are constituted as a combination of discharge port groups each including holes all having the same shape and the same size (see FIGS. 8 and 10).

As described above, the two aid droplets 173 and 174 act to promote the joining between the basic droplets 171 and 172.

Fourth Embodiment

A fourth embodiment is different from the first to third embodiments in that the nozzle member 5 of the discharge device 1 has six discharge ports, and it is similar to the first to third embodiments in the other points. In the following, description of common points to those in the first to third embodiments is omitted, and different points are described.

Figure 10:
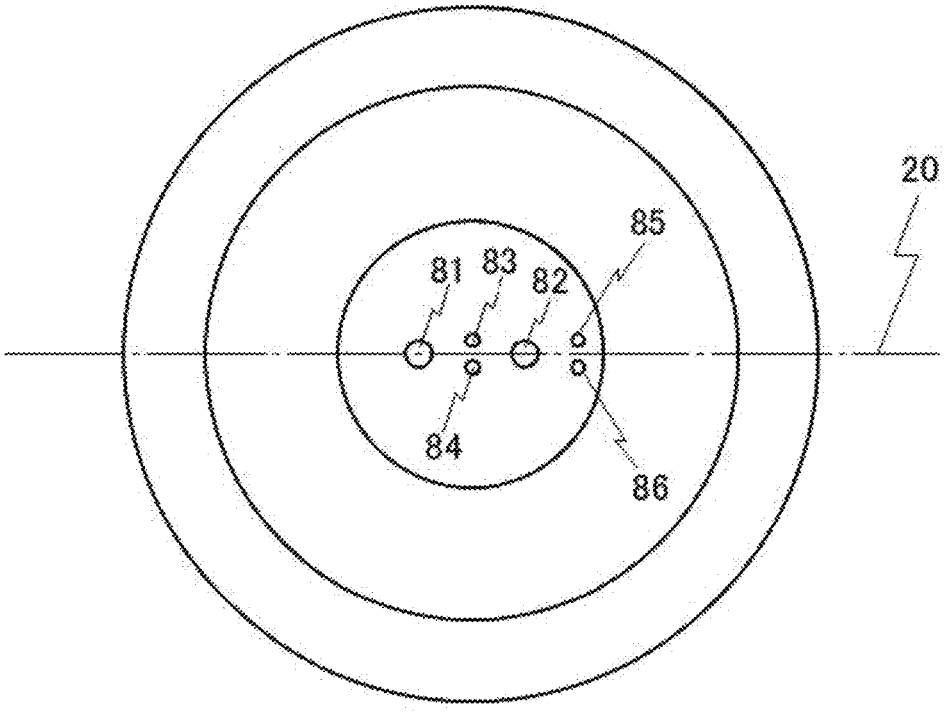
FIG. 10 is a bottom view of a nozzle member in a fourth embodiment.

As illustrated in FIG. 10, the nozzle member 5 has a first discharge port 81 and a second discharge port 82 having circular shapes of the same large diameter, which are formed to lie on the straight nozzle arrangement line 20, and a third discharge port 83, a fourth discharge port 84, a fifth discharge port 85, and a sixth discharge port 86 having circular shapes of the same small diameter, which are formed along the straight nozzle arrangement line 20. The third discharge port 83 and the fourth discharge port 84 are arranged on both sides of the nozzle arrangement line 20 in a symmetrical relation, and the fifth discharge port 85 and the sixth discharge port 86 are also arranged on both sides of the nozzle arrangement line 20 in a symmetrical relation. Stated in another way, the first to sixth discharge ports (81 to 86)

are arranged symmetrically with respect to the nozzle arrangement line 20. Stated in still another way, the plurality of discharge ports include a plurality of large-diameter circular discharge ports, and a plurality of small-diameter circular discharge port groups. The large-diameter circular discharge ports are all arranged to lie on the straight nozzle arrangement line 20. The plurality of small-diameter circular discharge port groups and the large-diameter circular discharge ports are alternately arranged. The small-diameter circular discharge port groups are each constituted by a plurality of small-diameter circular discharge ports arranged on both sides of the nozzle arrangement line 20 in a symmetrical relation.

A diameter $D_1$ of each of the first discharge port 81 and the second discharge port 82 is, for example, several ten μm to several mm. A diameter $D_2$ of each of the third discharge port 83, the fourth discharge port 84, the fifth discharge port 85, and the sixth discharge port 86 is ½ to 1/10 of the diameter $D_1$, and $D_2$ is, for example, several μm to several hundred μm.

The third discharge port 83 and the fourth discharge port 84 are arranged to lie on a straight line, which is perpendicular to the nozzle arrangement line 20, at a midpoint of a closest distance $L_1$ between the first discharge port 81 and the second discharge port 82 (i.e., a distance between a right end of the first discharge port 81 and a left end of the second discharge port 82). A closest distance $L_2$ ($L_1 \times ½$) between the straight line, which is perpendicular to the nozzle arrangement line 20 at the midpoint of the closest distance $L_1$, and each of the first discharge port 81 and the second discharge port 82 is set larger than the diameter $D_1$ in any cases; namely, the closest distance $L_2$ is set to be, e.g., 2 to 10 times the diameter $D_1$.

A closest distance $L_3$ between a straight line perpendicular to the nozzle arrangement line 20, along which straight line the fifth discharge port 85 and the sixth discharge port 86 are arranged, and the second discharge ports 72 is the same as $L_2$. When the discharge device 1 is mounted to the application device 200, the nozzle arrangement line 20 is arranged to be aligned with a direction in which a desired drawing line (straight line) is to be drawn. As in the first embodiment, the worktable 202 or the discharge device 1 may include a rotation mechanism such that an aligning direction of the discharge ports can be dynamically adjusted by the rotation mechanism.

In the case where the nozzle member has large-sized discharge ports and small-sized discharge ports as in this embodiment, the nozzle arrangement line 20 may be aligned with the direction in which the drawing line is to be drawn, by arranging the discharge ports such that the drawing line exists in a plane including the discharge direction of the liquid material discharged from the large-sized discharge ports.

The third to sixth discharge ports (83 to 86) having the circular shapes of the same small diameter function as supplemental discharge ports through which the supplemental liquid material serving to make even liquid masses in a coupling portion between the first and second discharge ports (81 and 82).

Figure 11:
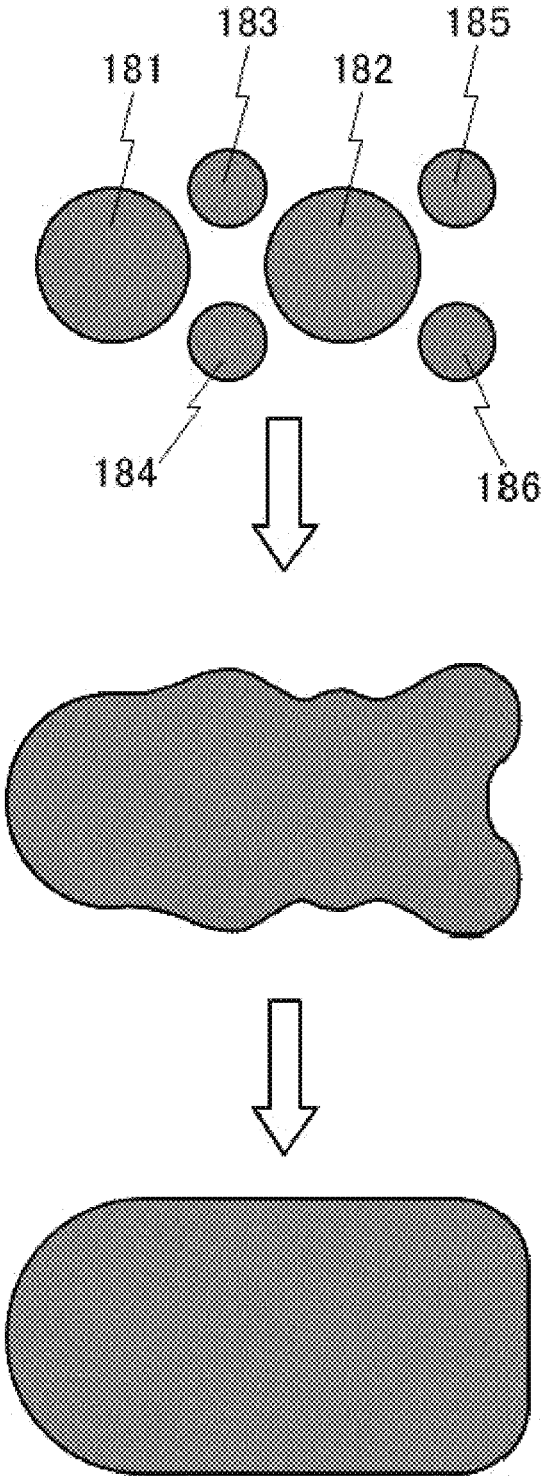
FIG. 11 illustrates an image, viewed from above, representing how six droplets discharged at the same time join together in the fourth embodiment.

FIG. 11 illustrates an image representing how six liquid masses discharged from the first to sixth discharge ports (81 to 86) at the same time land and spread on the application object. As illustrated in an upper area of FIG. 11, at the time of the landing, six droplets (181 to 186) discharged from the first to sixth discharge ports (81 to 86) at the same time are independent droplets each having a circular shape when viewed from above. As illustrated in a middle area of FIG. 11, after the lapse of a very short time from the landing, the six droplets (181 to 186) spread to start joining together. Finally, as illustrated in a lower area of FIG. 11, the six circles completely join together into such a state that an application line has a uniform width and a straight elongate application pattern extending in the same direction as the nozzle arrangement line 20 is formed.

As described above, the four aid droplets 183 to 186 act to smoothly eliminate recesses that are formed in the application line in the widthwise direction when the basic droplets 181 and 182 spread and join together. While each discharge port preferably has a circular shape in this embodiment as well, the shape of the discharge port is not limited to a circle.

Fifth Embodiment

A fifth embodiment is different from the first to fourth embodiments in structure of the nozzle member 5 of the discharge device 1, and it is similar to the first to fourth embodiments in the other points. In the following, description of common points to those in the first to fourth embodiments is omitted, and different points are described.

Figure 12:
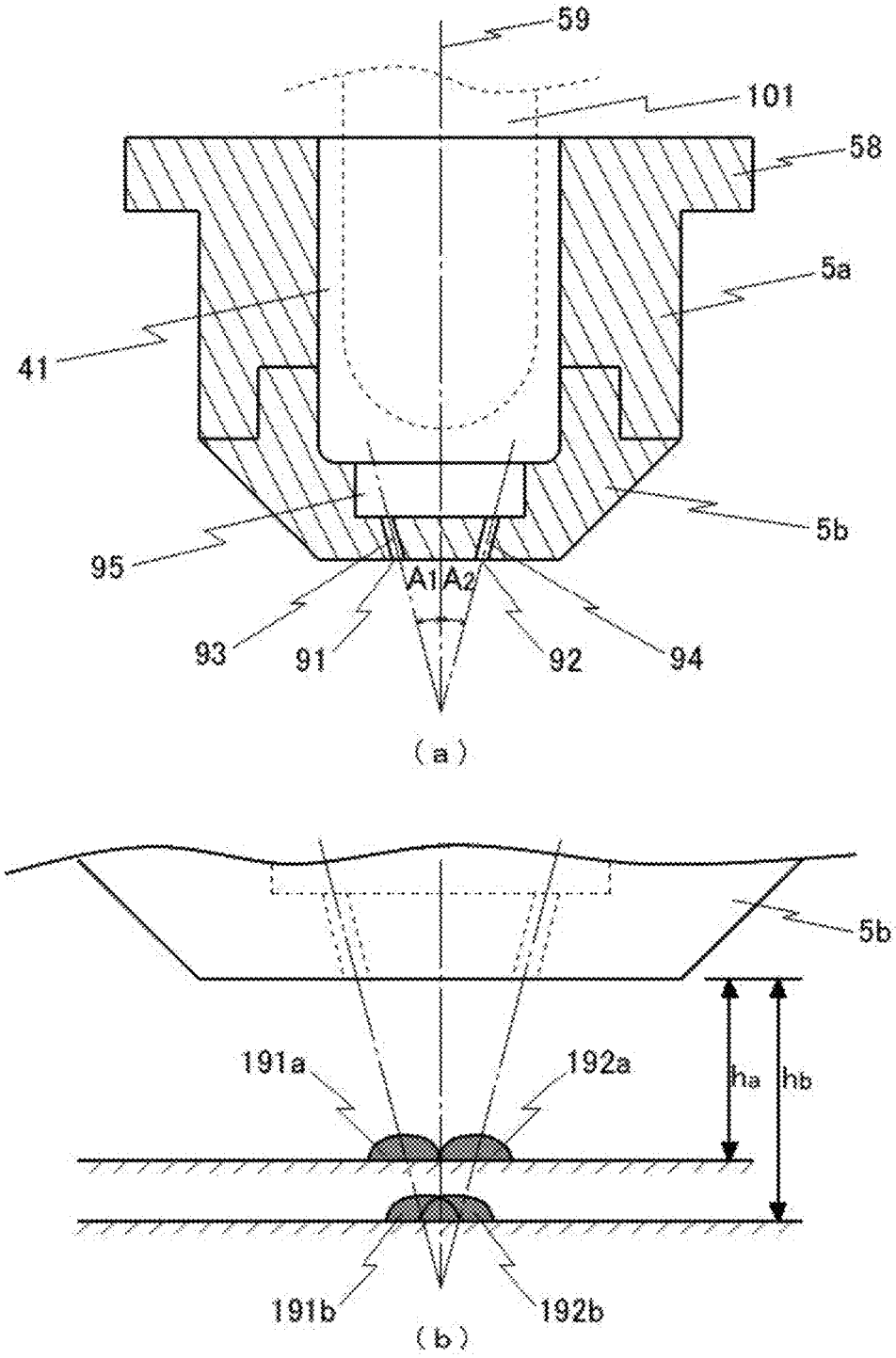
FIG. 12(*a*) is a side sectional view of a nozzle member in a fifth embodiment, and FIG. 12(*b*) is a side view referenced to explain a relation between a distance from a discharge port to a workpiece and a droplet-to-droplet distance.

As illustrated in FIG. 12(*a*), the nozzle member 5 in the fifth embodiment is constituted by an upper member denoted by a reference sign 5*a*, and a lower member denoted by a reference sign 5*b*. The nozzle member 5 includes a flange 58 at an upper end, and it is supported by the mounting member 4 at the flange 58. The lower member 5*b* is detachably fixed to a lower end of the upper member 5*a* by threaded engagement or with the aid of fixtures, e.g., screws. Since the lower member 5*b* is detachably mounted to the upper member 5*a*, the plurality of lower members 5*b* having the discharge ports different in port diameter, port-to-port distance, and/or ejection angle from the port can be easily replaced from one to another depending on uses. It is preferable to dispose a positioning mechanism capable of holding an orientation of the lower member 5*b* constant relative to the upper member 5*a* when the lower member 5*b* is fixed to the upper member 5*a*. The positioning mechanism can be constituted by suitable one of known positioning mechanisms. For example, the positioning can be implemented by a mechanism of engaging a part (e.g., a pin, a mouth, or a cutout) in one of the lower member 5*b* and the upper member 5*a* with a counterpart in the other, or a mechanism using a separately prepared member (e.g., a pin or a screw).

A first discharge port 91 is communicated with the liquid chamber 41 through a first discharge flow path 93 having a linear shape and a discharge flow path 95 having a large diameter. A second discharge port 92 is communicated with the liquid chamber 41 through a second discharge flow path 94 having a linear shape and the large-diameter discharge flow path 95. The first discharge flow path 93 and the second discharge flow path 94 have the same shape and are inclined at equal angles relative to a center axis 59 of the nozzle member. Thus, an angle $A_1$ formed by a center axis of the first discharge flow path 93 and the center axis 59 of the nozzle member and an angle $A_2$ formed by a center axis of the second discharge flow path 94 and the center axis 59 of the nozzle member are equal, and they are set to satisfy $A_1=A_2<45°$, for example.

In this embodiment, the discharge direction of the liquid material is assumed to be a direction in which the center axis 59 extends.

In the fifth embodiment, a distance between two liquid masses discharged at the same time can be adjusted by controlling a distance h between the discharge ports and the workpiece with the Z drive device 205. FIG. 12(*b*) illustrates an image representing a distance between two droplets (extent of overlap) in each of the case where the distance between the discharge ports and the workpiece is $h_a$ and the case where it is $h_b$. As seen from FIG. 12(*b*), the distance between the droplets increases as the distance h between the discharge ports and the workpiece decreases, and the distance between the droplets decreases as the distance h increases. It is important in this embodiment as well that the distance h is set to keep the plurality of droplets, which are discharged at the same time, in a state not contacting or joining with each other prior to the landing.

According to the above-described application device and application method of the fifth embodiment, the distance or the extent of overlap between two landed droplets can be adjusted by controlling the distance h between the discharge ports and the workpiece. Therefore, the discharge device is suitably adaptable for differences in the distance or the extent of overlap between the droplets, which are caused by differences in ambient environments, e.g., humidity and room temperature.

The number of discharge ports is not limited to two in the illustrated example, and it may be three or more. When the number of discharge ports is odd, the discharge port positioned at a center is not inclined, and the remaining discharge ports in pair, positioned at the same distance from the center, are inclined at equal angles relative to the center axis of the nozzle member.

When the distance h between the discharge ports and the workpiece is set to a very short distance, the ejection angles from the discharge ports may be set to discharge droplets in directions away from the center axis of the nozzle member (i.e., radially) such that the droplets join together on the workpiece.

INDUSTRIAL APPLICABILITY

The present invention can be employed in the cases of applying, of course, not only industrial greases, solder pastes, silver pastes, a variety of adhesives (including the UV-cured type, the epoxy-based type, and the hot melt type), and cream solders, but also liquid materials ranging from low-viscosity materials, e.g., solvents (about 0.8 cps), to high-viscosity materials (about 1,000,000 cps).

LIST OF REFERENCE SIGNS

1: discharge device, 2: body upper portion, 3: body lower portion, 4: mounting member, 5: nozzle member, 6: liquid feed member, 7: liquid reservoir, 8: air-type dispenser, 9: air supply source, 10: plunger, 11: piston, 12: sealing member, 13: elastic member, 14: stopper, 15: micrometer, 16: solenoid switching valve, 17: switching valve control unit, 18: pressure reducing valve (regulator), 19: air supply source, 20: nozzle arrangement line, 21: through-hole, 22: lower chamber, 23: upper chamber, 24: lower communication port, 25: upper communication port, 31: through-hole, 32: sealing member, 33: supply path, 41: liquid chamber, 42: liquid feed path, 51: first discharge port, 52: second discharge port, 53: third discharge port, 61: liquid feed path, 71: first discharge port, 72: second discharge port, 73: third discharge port, 74: fourth discharge port, 81: first discharge port, 82: second discharge port, 83: third discharge port, 84: fourth discharge port, 85: fifth discharge port, 86: sixth discharge port, 91: first discharge port, 92: second discharge port, 101: tip portion of plunger, 102: lateral surface of tip portion of plunger, 103: plunger tip surface, 200: application device, 201: bench, 202: worktable, 203: X drive device, 204: Y drive device, 205: Z drive device, 206: control device, 213: X-direction, 214: Y-direction, 215: Z-direction, 207: application object (workpiece), 411: inner side wall of liquid chamber, 412: bottom surface of liquid chamber

The invention claimed is:

1. An application method of drawing a drawing line on an application object using an application device, the application device comprising:

a discharge device;

a worktable on which the application object is placed;

a drive device for relatively moving the discharge device and the worktable; and a control unit for controlling operations of the discharge device and the drive device, the discharge device comprising:

a nozzle having a plurality of discharge ports through which a liquid material is discharged;

a liquid chamber in communication with the plurality of discharge ports through a plurality of discharge flow paths; and a discharge member contacting the liquid material inside the liquid chamber, wherein the application method includes steps of operating the discharge member to give an inertial force to the liquid material inside the liquid chamber, thereby discharging the liquid material from the plurality of discharge ports at the same time and forming a plurality of droplets on the application object, arranging the plurality of discharge ports in the nozzle along a nozzle arrangement line that is a straight line, aligning the nozzle arrangement line with a drawing direction in which the drawing line is to be drawn, and performing a line-drawing application by discharging the liquid material while the discharge device and the worktable are relatively moved in the same direction as the nozzle arrangement line, the liquid material being discharged such that a plurality of liquid masses discharged from the plurality of discharge ports do not contact with each other prior to landing on the application object, and that the liquid material having landed along the nozzle arrangement line join together on the application object to form a line.

2. The application method according to claim 1, wherein the control unit performs the line-drawing application through a step of, in a state of relatively moving the discharge device and the worktable in the same direction as the nozzle arrangement line while keeping a constant speed $V_c$, setting discharge timing to a constant interval $T_c$ on the basis of the relative moving speed between the discharge device and the worktable such that at least one of the plurality of discharged liquid masses joins with the liquid material just previously discharged onto the application object, thus forming the drawing line.

3. The application method according to claim 1, wherein a propulsion force of the discharge member is adjusted to discharge the liquid material such that the plurality of discharged liquid masses do not contact with each other prior to the landing on the application object, and that the liquid material having landed along the nozzle arrangement line join together on the application object.

4. The application method according to claim 1, wherein the plurality of discharge flow paths are arranged to incline such that respective center axes of the plurality of discharge flow paths intersect a center axis of the nozzle, and a distance between the droplets is adjusted by controlling a distance h between the discharge ports and the application object.

5. The application method according to claim 1, wherein the plurality of discharge ports are all arranged to lie on the nozzle arrangement line.

6. The application method according to claim 1, wherein all of the plurality of discharge ports have the same shape and are arranged at a uniform pitch.

7. The application method according to claim 1, wherein the plurality of discharge ports are an even number of discharge ports and include two first-sized discharge ports and two second-sized discharge ports, all of the discharge ports being arranged to lie on the nozzle arrangement line, and the second-sized discharge ports and the first-sized discharge ports are alternately arranged along the nozzle arrangement line, wherein the first-sized discharge ports are larger in port size than the second-sized discharged ports.

8. The application method according to claim 1, wherein the plurality of discharge ports are an even number of discharge ports and include two first-sized discharge ports and two second-sized discharge port groups, all of the first-sized discharge ports being arranged to lie on the nozzle arrangement line, the second-sized discharge port groups and the first-sized discharge ports are alternately arranged along the nozzle arrangement line, and the second-sized discharge port groups are each made up of a plurality of second-sized discharge ports that are arranged symmetrically with respect to the nozzle arrangement line.

9. The application method according to claim 1, wherein the discharge device or the worktable includes a rotation mechanism, and the nozzle arrangement line is aligned, by the rotation mechanism, with the drawing direction in which the drawing line is to be drawn.

10. The application method according to claim 9, wherein the line-drawing application is performed in accordance with an application pattern that includes a straight application line extending in a first direction and a straight application line extending in a second direction different from the first direction.

11. The application method according to claim 1, wherein the nozzle is detachably fixed to the discharge device, and the discharge device includes a positioning mechanism capable of mounting the nozzle such that a direction of the nozzle arrangement line is held constant relative to the discharge device.

12. The application method according to claim 1, wherein the discharge device comprises:

a plunger having a smaller diameter than the liquid chamber and including a tip portion that is moved forward and backward within the liquid chamber;

a plunger reciprocating device for moving the plunger forward and backward; and a liquid feed device for supplying the liquid material to the liquid chamber, wherein the liquid material is discharged from the plurality of discharge ports at the same time by moving the plunger forward and stopping the forward movement of the plunger in a state that a lateral surface of the tip portion of the plunger is not contacted with an inner side wall of the liquid chamber, thus giving an inertial force to the liquid material.

13. The application method according to claim 1, wherein the liquid material is discharged such that all the liquid masses simultaneously discharged from the plurality of discharge ports join together on the application object.

* * * * *